United States Patent [19]

Lorenzo

[11] Patent Number: 4,821,621

[45] Date of Patent: Apr. 18, 1989

[54] MULTIPURPOSE REPEATING FIREARM HAVING ALTERNATE FIRING MECHANISMS

[75] Inventor: Carmelo Lorenzo, Bronx, N.Y.

[73] Assignee: Car-Lin Inc., Bronx, N.Y.

[21] Appl. No.: 932,564

[22] Filed: Nov. 20, 1986

[51] Int. Cl.[4] ..... F41D 11/02

[52] U.S. Cl. ..... 89/143; 89/151; 89/199

[58] Field of Search ..... 42/71.02; 89/143, 151, 89/199

[56] References Cited

U.S. PATENT DOCUMENTS

| | | | |
|---|---|---|---|
| 1,359,045 | 11/1920 | Fisher | 89/151 |
| 1,365,743 | 1/1921 | Stokke | 42/71.02 |
| 1,381,016 | 6/1921 | Reising | 89/149 |
| 2,154,770 | 4/1939 | Petter | 89/151 |
| 2,167,672 | 8/1939 | Nomar | 89/199 |
| 2,391,757 | 12/1945 | Vesely | 89/151 |
| 2,585,620 | 2/1952 | Benson | 89/150 |
| 2,774,283 | 12/1956 | Harvey | 89/194 |
| 2,785,605 | 3/1957 | Jourdat | 89/140 |
| 3,483,648 | 12/1969 | Speckhart | 89/151 |
| 3,736,839 | 6/1973 | Childers | 89/151 |
| 4,003,292 | 1/1977 | Christakos | 89/145 |
| 4,109,559 | 8/1978 | Davis | 89/195 |
| 4,448,109 | 5/1984 | Johnson | 89/143 |
| 4,522,105 | 6/1985 | Atchisson | 89/139 |
| 4,553,468 | 11/1985 | Castellano et al. | 89/140 |
| 4,575,962 | 3/1986 | Rogak et al. | 89/194 |

OTHER PUBLICATIONS

Webster's New World Dictionary of the American Language, 1957, p. 1233.

*Primary Examiner*—Stephen C. Bentley

*Attorney, Agent, or Firm*—Stevens, Davis, Miller & Mosher

[57] ABSTRACT

A relatively simple repeating firearm is disclosed which includes a sliding bolt which is removably housed within a firearm housing and which is biased into a bullet loading and firing position by means of springs provided in an overlapping fashion with a longitudinal extent of the bolt to thereby reduce the overall length of the firearm. A short stroke for the sliding bolt is provided to enable a rapid firing of the firearm. The sliding bolt and firing mechanism contained thereon are easily removed from the housing by a removable rear cover with the firearm accommodating different calibers of bullets by replacement of the sliding bolt as well as a removable barrel which contains the firing chamber therein.

41 Claims, 6 Drawing Sheets

MULTIPURPOSE REPEATING FIREARM HAVING ALTERNATE FIRING MECHANISMS

BACKGROUND OF THE INVENTION

The present invention is directed to a multipurpose repeating firearm having a simplified construction.

Typical repeatable firearms have a complex structure for the bolt and firing mechanism which makes the overall firearm construction complex. This also tends to make the firearm heavy, and expensive and also results in a considerable number of parts which can fail leading to failure of the firearm. In addition, the bolt and firing mechanism also tend to be cumbersome in operation introducing undesirable friction and slowing operation of many of the functional parts of the firearm, thereby slowing the firing rate when in an automatic mode.

In addition, the complexity of the construction of typical automatic firearms makes disassembly for inspection and repair difficult, and field repair is particularly difficult to accomplish.

Furthermore, most automatic firearms are designed for a specific bullet caliber so that different firearm configurations are required to handle different bullets of different size. This results in using the firearm only with a single caliber bullet, and requiring the manufacture and stocking of different models of the same firearm for different caliber bullets.

SUMMARY OF THE INVENTION

The present invention has been designed with the foregoing shortcomings of conventional repeating firearms in mind.

One of the objects of the present invention is to provide a firearm which can be used in an automatic or semiautomatic mode, which has a simplified construction for the bolt and firing mechanism assembly, and which is lighter in weight, and less expensive to produce than conventional firearms.

Another object of the invention is the provision of a firearm having fewer parts than conventional automatic and semiautomatic firearms and which has a quick action and short bolt stroke and is capable of producing a rapid firing when in the automatic mode.

Another object of the invention is the provision of a firearm which can be quickly disassembled, whereby a sliding bolt and firing mechanism can be easily removed from the firearm and replaced as necessary.

Another object of the invention is the provision of a small sized firearm in which its length is substantially determined by the length of a bullet and a length of the bolt, thereby producing a shorter, more compact and faster acting structure.

Another object of the invention is the provision of a firearm having a dual action firing mechanism, whereby the firearm can be easily and reliably operated in an automatic mode or in a semiautomatic mode.

Another object of the invention is the provision of a firearm which can have its bullet caliber easily changed so that the same basic housing and trigger mechanism can be used for different size bullets, thereby simplifying manufacture and assembly costs.

These and other objects and advantages of the invention are provided in a firearm which uses a biased sliding bolt assembly upon which a firing mechanism is mounted. The sliding bolt assembly slides within an interior area of a housing and is biased forwardly toward a firing chamber and is movable away from the firing chamber and against the bias. In the forward mode the slide bolt, propelled by the bias, loads a bullet into the firing chamber for firing and in a rearward mode accumulates energy in the biasing mechanism for propulsion of the bolt forward during the next firing sequence. The sliding bolt is easily removed from he housing by a removable rear cover whereby the sliding bolt can be removed, inspected, and repaired or replaced as necessary. To reduce the overall size of the weapon, a pair of springs which are used as the biasing mechanism are providing in an overlapped relationship with the sliding bolt so that the length of the firearm is largely dependent on a length of a bullet used therewith, plus a length of the sliding bolt.

The sliding bolt only moves rearwardly just enough for the front face thereof to clear the rear of a casing of a bullet placed in a position to be carried forwardly, to thereby reduce the overall length of the firearm.

The caliber of the firearm is easily changed by providing a snap-on twist-type construction for the barrel which includes at its end the firing chamber and by the removable sliding bolt discussed above, whereby a sliding bolt having a front, bullet-pushing face configured for a specified caliber of bullet can be readily inserted into the housing.

In a first embodiment, the firing mechanism is carried by the sliding bolt and as the sliding bolt reaches the termination of its bullet-loading forward movement, the bullet is fired.

In a second embodiment, a dual firing mechanism is provided wherein a first firing mechanism operates as described above for an automatic firming mode, while a second normally disengaged, firing mechanism is used for a semiautomatic firing mode. With this arrangement, even if the weapon becomes inoperative for some reason when in a fully automatic mode, it still may be operated in a semiautomatic mode.

The above objects and advantages of the invention as well as structures and features thereof will be more clearly understood from the following detailed description of the invention which is provided in connection with the accompanying drawings.

DETAILED DESCRIPTION OF THE INVENTION

Figure 1:
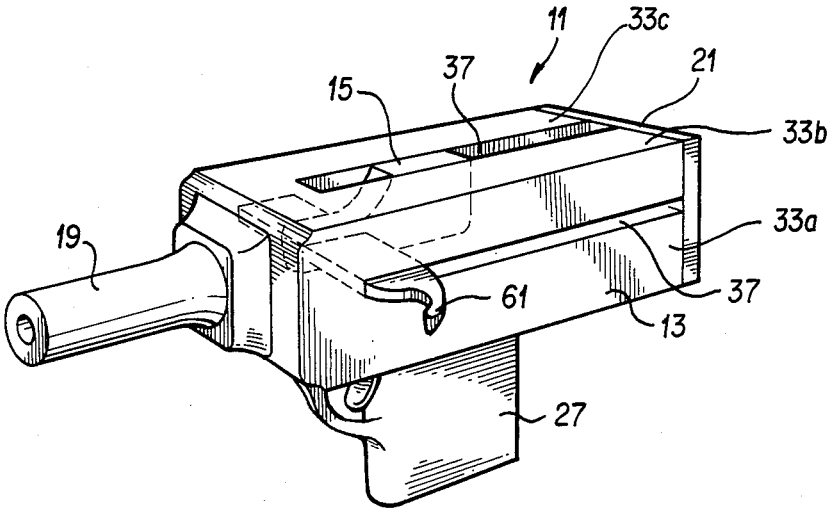
FIG. 1 illustrates in perspective view of one embodiment of a firearm constructed in accordance with the teachings of the invention.

FIG. 1 illustrates in perspective view a firearm constructed in accordance with a first embodiment of the invention. The firearm includes a main housing 13 which has an interior area or space 17 (FIG. 2) within which a bolt 15 is slidable in a forward direction towards a firing chamber 39 and in a rearward direction towards a rear cover 21 of the housing. The firearm includes a downwardly depending clip support member 27 within which a magazine containing a plurality of stacked bullets can be slidably accommodated, as more clearly illustrated in FIG. 2. The interior area 17 provides a longitudinal path within which sliding bolt 15 travels, the interior sidewalls of the housing 13 serving to define the guiding path for the sliding bolt 15. The bolt 15 is biased in a forwardly propelling direction by means of a pair of springs 43 which engage with projections 41 provided on either side of sliding bolt 15. The springs 43 are provided in overlapping relationship with a substantial protion of the sliding bolt 15 to eliminate a requirement for space behind the sliding bolt when it is in its rearwardmost position. Accordingly, as shown more clarly in FIG. 8, when the sliding bolt 15 is at its rearwardmost position, the back wall thereof is provided substantially adjacent a rear wall 20 of cover 21 defining an end of interior area 17.

The housing 13 is formed of a plurality of generally rectangular extending members 33*a*, 33*b*, 33*c* and 33*d* (FIG. 9*a*) which are provided in continuation of a front portion 35 of the housing. The extending members 33*a* . . . 33*d* are integrally connected to the front portion 35 and extend therefrom rearwardly of the firearm 11. The plurality of extending members at their distal ends are interconnected by means of an end cover 21 in the form of a plate which is screwably fastened to the distal ends of the extending members to form rear wall 20 of housing 13. Removal of the screws and thus plate 21 allows the sliding bolt 15 and associated springs 43 to be removed from the open rear of the housing 13.

The projections 41 provided on opposite sides of sliding bolt 15 are designed to guide the sliding bolt in its forward and rearward movement within housing 13. The extending members 33*a* . . . 33*d* are arranged to have spaces therebetween which function as guide slots 37 which extend longitudinally of housing 13. The guide slots 37 provided on opposite sides of housing 13 serve to guide the projections 41 of the sliding bolt 15. An upper slot 37 which is typically wider than the slots 37 provided on the side of the housing serves to guide an upper portion of the sliding bolt 15, as shown in FIG. 1, and also provides an opening through which spent bullet casings can pass.

Figure 6:
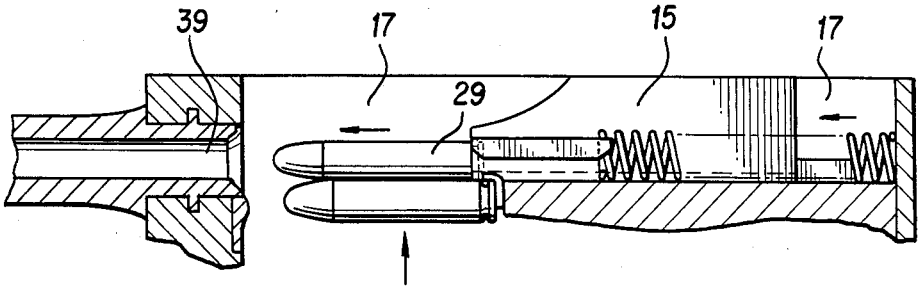
FIG. 6 illustrates in side sectional view the beginning of a bullet loading operation.

As shown in FIG. 6, the sliding bolt 15 has a front face which engages with a rear portion of a bullet received through a bullet receiving opening 23 provided in an underside of housing 13 and at an uppermost portion of the clip support 27. The sliding bolt 15 in its forward movement carries the received bullet forwardly. Initially the front face of the sliding bolt 15 only engages with a portion of a rear face of a bullet casing 29 as the bullet is held down by a retainer 67 provided within support 27. However, as the bullet 29 moves forward it clears the retainer 67 and the spring bias provided by the clip pushes the bullet upwardly whereupon the rear face of the bullet seats on the front face of the sliding bolt 15. Continued forward movement of sliding bolt 15 causes the bullet to be seated within a firing chamber 39. Thus, upon backward and subsequent forward movement of the sliding member 15, a bullet is moved from the top of a bullet clip mounted in clip support 27 into a firing chamber 39.

Figure 2:
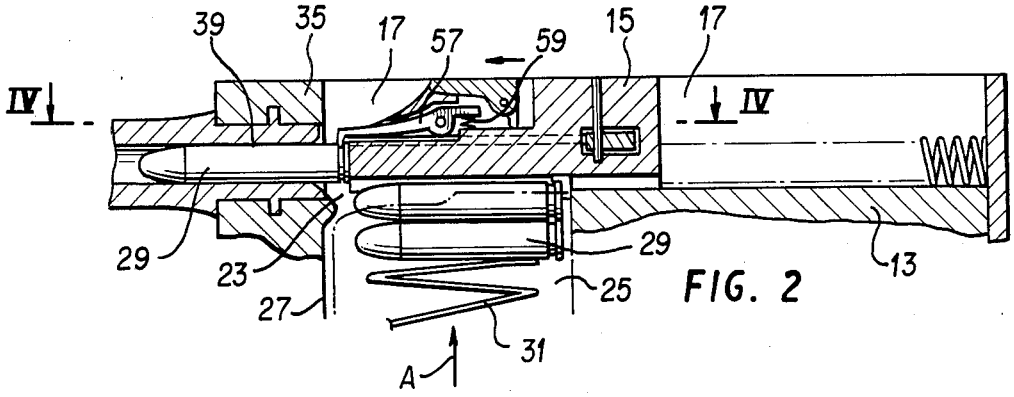
FIG. 2 illustrates a cutaway side view of a portion of the FIG. 1 embodiment.
Figure 3:
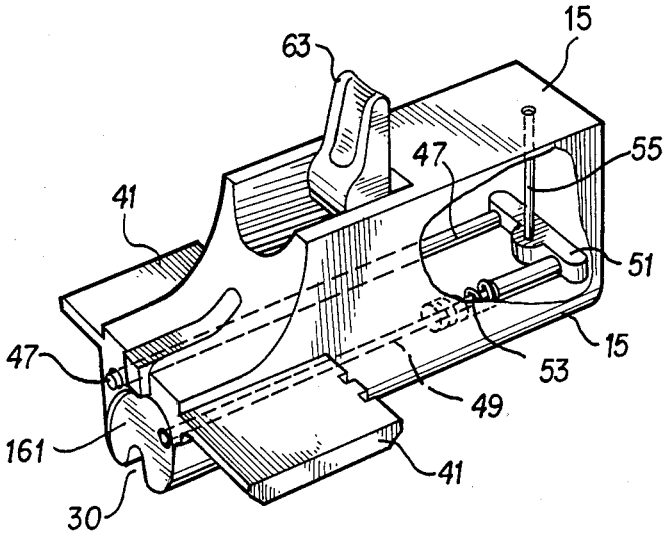
FIG. 3 illustrates the sliding bolt employed in the first embodiment.

The firing mechanism in the FIG. 1 embodiment is carried directly on the sliding bolt, and is shown in greater detail in FIGS. 2 and 3.

The firing mechanism includes a firing pin 49 which is provided in the form of a rod which is slidable in a corresponding bore extending along the longitudinal extent of the sliding bolt 15 and aligned in the direction of movement of the sliding bolt. The firing pin 49 is biased in a normally retracted condition by means of a spring 53 acting on a projection provided on the firing pin and a corresponding projection provided on the interior bore of the sliding bolt 15. An additional contact member 47 in the form of a rod is also provided which also extends through a longitudinal bore in the sliding bolt 15 and is generally arranged in parallel with firing pin 49. The contact member 47 is coupled with the firing pin 49 by means of a coupling member 51 which is rotatable about a pivot pin 55. The biasing of spring 53 causes the firing pin 49 to be normally in a retracted position which in turn causes coupling element 51 to be biased in a counterclockwise state when viewed from above causing contact member 47 to project a small distance from a front surface of the sliding bolt 15. As a consequence of this, when the sliding bolt 15 moves forwardly, the projecting tip of the contact member 47 contacts with a front interior wall of the housing 13 surrounding the firing chamber 39 causing the contact member 47 to move rearwardly pivoting the coupling member 51 and causing the firing pin 49 to immediately project from the front face 161 of the sliding bolt 15. This causes a bullet 29 to be fired as soon as the sliding bolt 15 loads it in the firing chamber 39.

As the sliding bolt 15 moves forwardly to load a bullet 29 into the firing chamber 39 a casing holder 57 having a projection provided at the front of the sliding bolt 15 adjacent the bullet pushing face 161, engages with a rear edge of the bullet casing as the bullet 29 clears retainer pin 67. This engagement continues both during loading and during initial rearward movement of the sliding bolt 15 which occurs upon the firing of a bullet 29. Bullet firing causes a rearward propulsion of the sliding bolt 15 against the biasing of springs 43.

Figure 5:
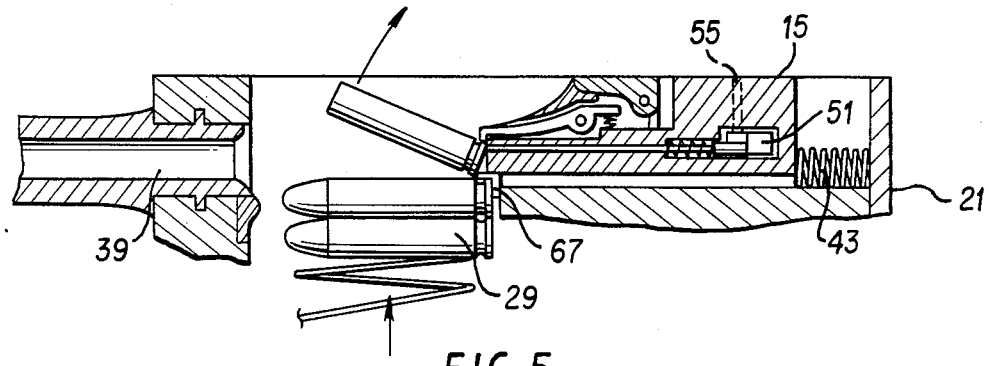
FIG. 5 illustrates in side sectional view the ejection of a spent cartridge through an opening in a housing of the FIG. 1 embodiment.

As a spent casing of the bullet moves rearwardly together with the sliding bolt 15, a peripheral portion of the bullet casing strikes the retainer pin 67 which provides a pivot point for the bullet casing, as shown in FIG. 5. The continued pulling movement of the spent casing by means of the casing holder 57 causes a rotation of the casing about the retainer pin 67 and its upward and outward projection from the housing 15 through the slot 37 provided at the top of housing 13. In this manner, a spent casing is ejected from the housing. The casing holder 57 is biased in a position for holding a bullet casing by a spring 59 and as a bullet is rotated about retainer pin 67 the bullet causes a small amount of upward movement of casing holder 57 against the force of spring 59.

As the sliding bolt 15 is propelled rearwardly by the force of a fired bullet, the front bullet pushing face 161 thereof just clears the rear face of the next topmost bullet in bullet clip 25 and as the bottom surface of the sliding member clears the topmost bullet, spring 31 provided in the bullet clip is able to push the next bullet in a clip up to a position where it will be retained by retainer pin 67 and received and pushed by the next forward stroke of the sliding bolt 15. The sliding bolt 15 has a longitudinal groove 30 in its undersurface to allow the sliding bolt 15 to move forwadly and rearwardly past the retainer pin 67.

The springs 43 are preferably held and guided by longitudinal guides 45 which are provided in the slots 37 on opposite sides of the housing 13. The guides 45 are in the form of grooves with respective groove faces being provided on opposing surfaces of an extending members 33*a* . . . 33*d*. The guides 45 are more clearly illustrated in FIG. 9*a*.

Figure 3A:
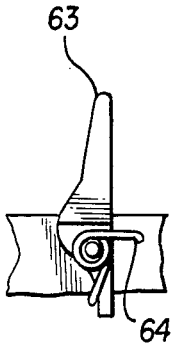
FIG. 3*a* illustrates in cutaway side view a portion of the sliding bolt shown in FIG. 3.
Figure 4A:
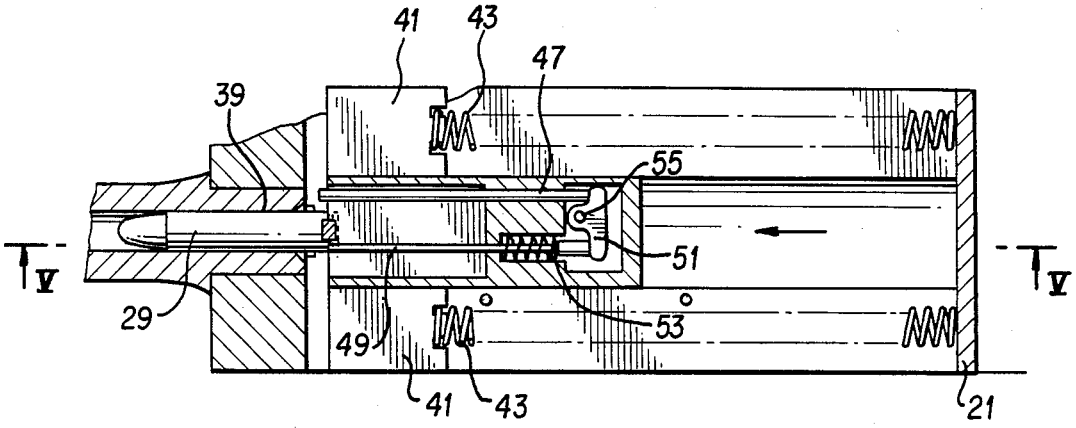
FIG. 4*a* illustrates in sectioned top view the operation of the first embodiment of the invention in loading a bullet into a firing chamber.
Figure 4B:
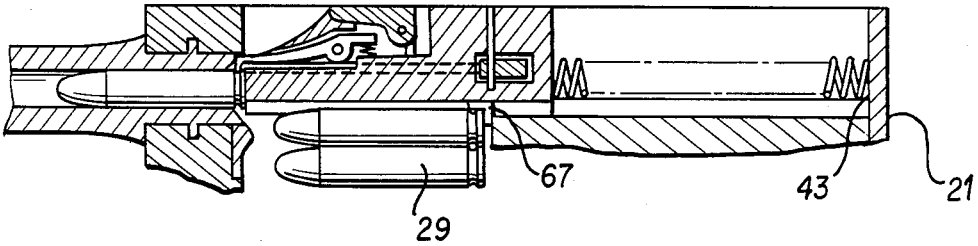
FIG. 4*b* illustrates in side sectional view the loading operation.
Figure 7:
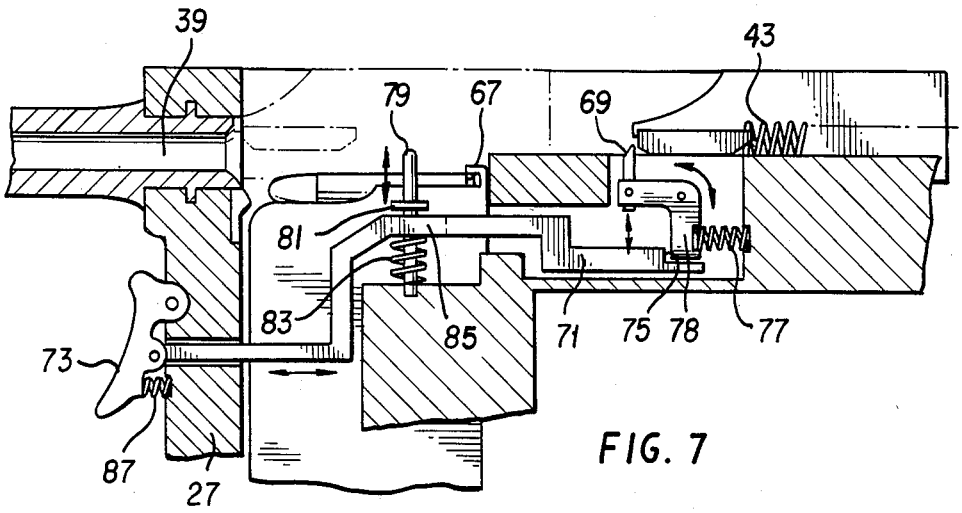
FIG. 7 illustrates in a side cutaway view the trigger mechanism employed in the FIG. 1 embodiment.

The manner of operation of the sliding bolt 15 thus far described can be controlled so that the sliding bolt provides a firearm having an automatic or semiautomatic firing sequence. FIG. 7 illustrates a trigger mechanism for operating the sliding bolt 15 in a semiautomatic firing sequence. In such a sequence it is first necessary to manually retract the sliding bolt 15 from the forwardmost position to a position illustrated in FIG. 8 where the sliding member is at its rearmost position. This initial rearward movement of the sliding bolt 15 is effected manually by grasping the sliding bolt 15 directly. To facilitate such grasping, a projecting extension 61 can be provided on one of the sliding bolt projections 41, as illustrated in FIG. 1. Alternatively or in combination, a grasping element 63 can be provided as shown in FIG. 3 at the top of the sliding bolt 15. This grasping element includes a pivoting finger grip 63 which is normally rotatable counterclockwise and positioned to form a flat upper surface on the sliding bolt 15 but which may be graspable by a user's finger and clockwise rotated as illustrated in FIG. 3*a*, to a vertical position whereby it is restrained from further movement, enabling a grasping projection to be formed by which an operator can pull the sliding bolt 15 rearwardly of housing 13. Once pulled rearwardly, a projection 41 of the sliding bolt 15 moves over and thus depresses a sear 69 until its front face clears sear 69 allowing the sear, which is connected to a rocking lever 75, to move upwardly to lock against the front face of the projection by means of the bias of spring 77 on the rocking lever 75. The sear 69 now holds the manually retracted sliding bolt 15 in a locked condition for firing. In this condition, also shown in FIG. 8, the springs 43 are tightly compressed within the guides 45.

To initiate firing, an actuator 71 is provided which is coupled to a trigger 73. The actuator and trigger 73 are biased to a rest position as shown in FIG. 7 by a spring 87. The actuation of trigger 73 causes a displacement of the actuator 71 to the right as shown in FIG. 7 which causes a control face 78 of the actuator 71 to also move rightwardly and abut against rocking lever 78 causing it to rock in a counterclockwise direction. This in turn causes the sear 69 to move downwardly to a position where it releases from holding the front face of the projection 41 of the sliding bolt 15 whereby the sliding bolt is propelled forwardly by the compressed springs 43. As the sliding bolt 15 moves forwardly and as discussed earlier, it picks up a topmost bullet provided in a bullet clip 25 and in addition, the projection 41 contacts with a control pin 79 as the sliding bolt 15 moves forwardly causing the pin 79 to be moved downwardly until the projection 41 clears the pin 79 in which case it is biased by spring 83 to return to its uppermost position. Pin 79 is connected to an overside plate 81, which, upon downward movement of pin 79 presses on an upper face of the actuator 71 thereby pressing it downwardly. As a consequence of this, the actuator 71 will move downwardly as the sliding bolt moves forwardly and rearwardly during the time that pin 79 is under projection 41. This downward movement of actuator 71 in all cases uncouples actuator 71 from lever 75 so that lever 75 can be biased by spring 77 back in a counterclockwise manner to a position where sear 69 is again in a position to receive and lock the sliding bolt 15 when it again reaches it rearwardmost position. Thus, even if trigger 73 is held, that is not released by an operator, sear 69 will still return to a position for holding the sliding bolt thereby preventing continual forward and backward movement of the sliding bolt 15 and automatic operation of the firearm. Actuator 71 includes a slot 85 therein through which pin 79 passes so that actuator 71 can move leftwardly and rightwardly as shown in FIG. 7 in accordance with movement of trigger 73. If automatic operation of the firearm is desired, pin 79 and its associated spring 83 can be removed. In this case, as long as trigger 73 is actuated plate 75 will be rotated to a position whereby once the sliding bolt 15 reaches its rearwardmost position it once again immediately commences a forward movement to load and fire another bullet.

Actuator 71, control pin 79, oversize plate 81 and spring 83 are all provided within a portion of housing 13 and associated clip support 27.

As noted earlier, end cover 21 is in the form of a plate which is screwably coupled to each of the extending members 33*a* . . . 33*d*. Removal of plate 21 by removal of the respective screws holding it to extending members 33*a* . . . 33*d* allows the sliding bolt 15 to be slidably removable from the housing together with the springs 43. Accordingly, the sliding bolt and firing mechanism associated therewith can be easily inspected and replaced or repaired as necessary. In addition, for accommodation of different caliber bullets, a different sliding bolt having a different size area for pushing face 161 can also be provided, thereby enabling the use of a sliding bolt 15 particularly designed for a desired caliber bullet.

Figure 8:
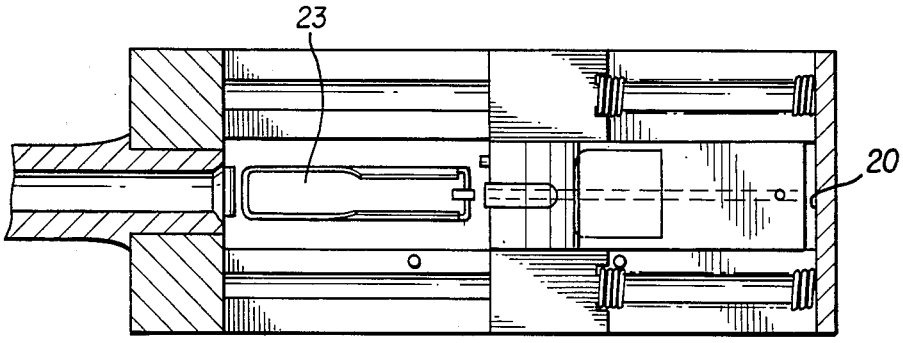
FIG. 8 illustrates in top sectional view the FIG. 1 embodiment with the sliding bolt in its rearwardmost position.
Figure 9A:
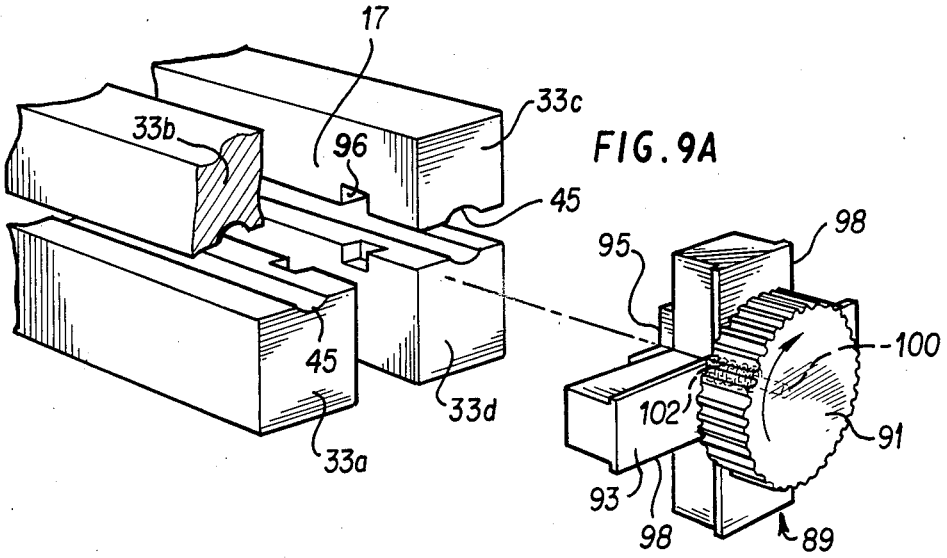
FIG. 9*a* illustrates in perspective view the rear of FIG. 1 embodiment provided with an easily removable cover.
Figure 9B:
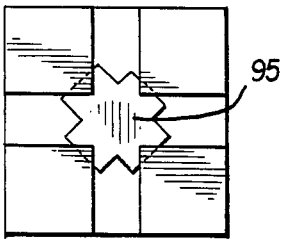
FIG. 9*b* illustrates a view toward the rear portion of the housing of the FIG. 1 embodiment with the rear cover in place.

In lieu of the plate-like removable cover 21 illustrated, for example, in FIGS. 1, 2 and 8, a rear cover illustrated in FIGS. 9*a* and 9*b* which is more readily manually removable may be provided. The modified rear end cover 89 illustrated in FIGS. 9*a* and 9*b* includes a cross piece insert 93 which is designed to fit into the slots 37 provided between the extending members 33*a* . . . 33*d* at the rear of housing 13. The crosspiece insert 93 includes a rear lip 98 which abuts against the ends of members 33*a* . . . 33*d*. In addition, a rotary operating member 91 is provided on a rod 100 extending through the crosspiece insert 93. The rod 100 is in turn coupled to a rotary plate 95 and is biased by a spring 102 surrounding the rod and abutting the crosspiece 93 and rotary member 91 such that plate 95 is pressed against crosspiece 93 and rotary operating member is biased away from crosspiece 93. The rotary plate 95 is designed to pass between the slots 37 and into the housing 13 together with the crosspiece 93 and after lip 98 of crosspiece 93 abuts members 33*a* . . . 33*d* the rotary member 91 is pushed in to align the rotary plate 95 with the notches 96 and then rotated whereby plate 95 rotates into engagement with interior notches 96 provided on each of the extending members 33*a* . . . 33*d*. FIG. 9*b* illustrates the condition of the rotary plate 95 with the modified end cover 89 in place. The modified end cover 89 is a quick connect/disconnect structure whereby a push-in and rotation operation of knob 91 and thus of plate 95 serves to easily engage and disengage the rear cover 89 to and from the remainder of the housing thereby allowing for a quick assembly and disassembly.

Figure 14:
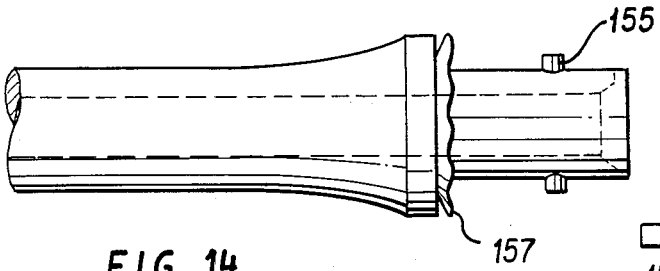
FIG. 14 illustrates a removable barrel construction for use in both embodiments of the invention.

As discussed above, a different sliding bolt 15 can be accommodated within the interior area of the housing 13 in order to accommodate, for example, bullets of different caliber. In order to further accommodate different caliber bullets, a removable barrel assembly is provided, as shown in FIG. 14. The barrel includes the usual barrel portion 19 (FIG. 1) projecting from the housing 13, but a rear portion of the barrel is formed as an insert into the housing and includes the firing chamber 39 therein. A pair of projections 155 are provided on the outer periphery of the barrel for sliding in suitable slots provided in the front portion 35 of housing 13 with the grooves also extending partly circumferentially of the barrel so that the barrel can be pressed in and turned and thus locked to the front of housing 13. Since the barrel includes the firing chamber 39 therein, the firing chamber can have different sizes corresponding to different calibers of bullets which may be used with the firearm. The barrel includes a spring plate 157 mounted at a peripheral flange of the barrel which is compressed between the peripheral flange of the barrel and front face of the housing 13 when the barrel is mounted to the housing. Thus, by changing a barrel 9 and, if necessary, a sliding bolt 15 as well, a firearm is provided containing an essential housing and trigger mechanism which can be used with different caliber bullets by merely suitably selecting a barrel and a sliding bolt 15 to accommodate the desired bullet size.

Figure 10:
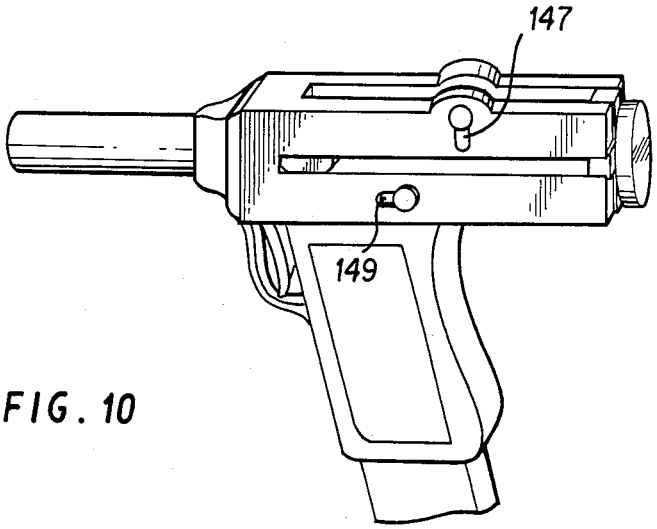
FIG. 10 illustrates a second embodiment of the invention incorporating the removable cover illustrated in FIGS. 9*a* and 9*b;*
Figure 11:
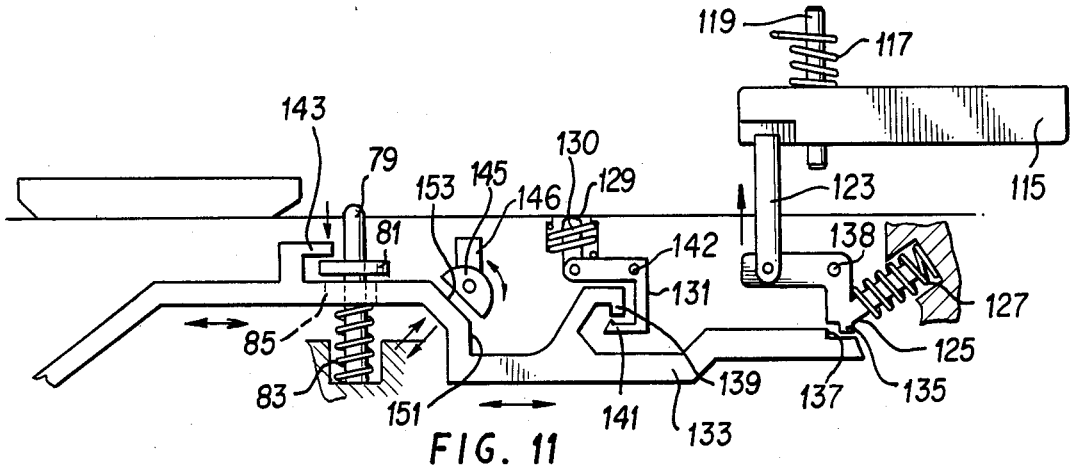
FIG. 11 illustrates in cutaway side view a portion of the trigger mechanism of the FIG. 10 embodiment of the invention.
Figure 12:
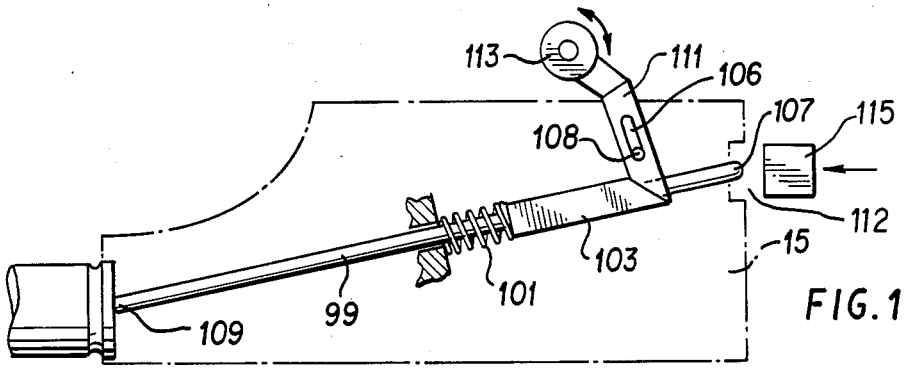
FIG. 12 illustrates in cutaway side view the sliding bolt construction used in the FIG. 10 embodiment of the invention.
Figure 13:
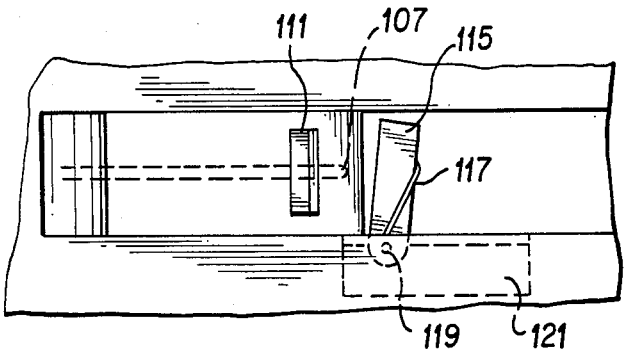
FIG. 13 illustrates in top sectional view a portion of the firing mechanism used in the FIG. 10 embodiment of the invention.

A second embodiment of the firearm of the invention is illustrated in FIGS. 10–13, 15*a* and 15*b*. In this embodiment, two firing mechanisms are employed, one provided on the sliding bolt 15 and the other provided on the housing and capable of interacting with the firing mechanism on the sliding bolt 15. The sliding bolt 15 in this embodiment, is illustrated in FIGS. 12 and 13, and generally has the same construction and shape as the sliding bolt 15 provided in the first embodiment. However, the firing mechanism carried by the sliding bolt 15 is different. As shown in FIG. 12, firing pin 99 is provided having a front end 109 which is adapted to strike the rear of a casing of a bullet and a rear end 107 which projects out of the rear of the sliding bolt 15 into a recess 112 provided at the rear side of bolt 15. The rear end 107 of the firing pin does not extend out of the recess 112. The firing pin 99 is biased by spring 101 engaging with a wall of the firing pin and a wall of an internal bore containing the firing pin 99 in a retracted direction whereby the end portion 107 projects out of the rearward side of the sliding bolt 15 and into recess 112. The firing pin 99 includes an oversized block-like portion 103 extending widthwise thereof and is able to slidably move within the sliding bolt 15. The block-like portion 103 is coupled to a firing control member 111 which is in the form of another block-like member provided to extend generally vertically and forwardly of the sliding bolt 15. This member contains a slot 106 through which a fixed pin 108 extends. Due the biasing of spring 101, the firing pin 99 is generally biased in a rearward direction of the sliding bolt 15 which in turn tends by virtue of the mating inclined surfaces of the block-like projection 103 and firing control member 111, to bias the firing control member 111 upwardly out of an uppermost surface of the sliding bolt 15.

A rotatable projection 113 is also provided on housing 13 and has a face positioned within interior area 17 and engageable with an upper face of the firing control member 111 when the sliding block bolt 15 moves forwardly to load a bullet within a firing chamber 39. Thus, as the bullet is loaded, the firing control member 111 strikes the projection 113 and moves downwardly to cause the firing pin 99 to move leftwardly as viewed in FIG. 12 and thus fire the just-loaded bullet.

The rotatable projection 113 is in turn connected to an operating lever 147 provided on the exterior of the firearm, as shown in FIG. 10. Thus, rotation of lever 147 controls the positioning of projection 113. In the position shown in FIG. 12, the projection 113 contacts with the firing control member 111 at the termination of the forward movement of the sliding bolt 15. However, lever 147 can also rotate projection 113 to a position whereby the firing control member 111 cannot make contact with the projection 113 on its forward movement. As a consequence, lever 147 controls whether the firing control member 111 will be used to fire a bullet. When the lever 147 is rotated to a position whereby projection 113 cannot engage with the firing control member 111, then firing of the bullet is controlled by the striking of the rear portion 107 of the firing pin 99 by a separate hammer 115 (FIGS. 11–13) which is pivoted to said housing at a pivot 119. A spring 117 biases the hammer 115 to a position shown in FIG. 13 whereby it rotates to enter recess 112 and strike the rear portion 107 of the firing pin 99 thus firing a bullet. Normally, hammer 115 is retracted against the bias of spring 117 into a recess 121 provided on an interior sidewall of the housing 13. It is held in this retracted position by a sear 123 (FIG. 11) and is rotatable to a cocked position within recess 121 by a rearward movement of the sliding bolt 15 which abuts on its rear surface with the hammer 15. This cocking of the hammer 15 can be accomplished manually by pulling the sliding bolt 15 backwardly as discussed above with respect to the FIG. 1 embodiment, or by the firing of a bullet which causes the rearward movement of the sliding bolt 15, and its consequent abutment with and rotation of hammer 115 against the bias of spring 117. Upon rotation of hammer 115 by rearward movement of the sliding bolt 15 sear 123 which is biased in an upward direction, as shown in FIG. 11, engages with a hole provided in an under surface of the hammer 115 to maintain it in its cocked position.

The manner in which the hammer 115 is released to strike the firing pin 99 will now be described with particular reference to FIG. 11.

An actuator 133 is provided which is similar to actuator 71 in the first embodiment of the invention and which is coupled in a similar manner to a trigger 73 (not shown in FIG. 11). The actuator is moved leftwardly and rightwardly as shown in FIG. 11 and is further movable vertically up and down. Sear 123 is coupled to a rocking lever 125 which is biased in a clockwise direction by spring 127. When actuator 133 is moved rightwardly, as viewed in FIG. 11, a control face 137 thereof abuts against and moves a projection 135 of the rocking lever 125 whereby the latter rotates counterclockwise about pivot 138 pulling down the sear 123 and releasing the hammer 115 causing the hammer to rotate counterclockwise by spring 117, as viewed in FIG. 13, to strike the end portion 107 of firing pin 99. In this embodiment, an additional sear 129 is provided for engagement with a front edge of a projection 41 of bolt 15 which is similar to sear 69 provided in the first embodiment of the invention. Sear 129 is connected to a rocking lever 131. Normally, sear 129 is biased by a spring 130 into the retracted state shown in FIG. 11 allowing unimpeded forward and backward movement of sliding bolt 15. Lever 131 is normally disengaged from an extending projection 139 on actuator 133, whereby any rightward movement of actuator 133 will have no effect on sear 129. Thus, in the state illustrated in FIG. 11 the sliding bolt 15 can be manually pulled rearwardly whereupon hammer 115 is rotated by rearward movement of the sliding bolt 15 to a cocked condition where it is held by sear 123 and then the sliding bolt can be released to move forwardly and load a bullet into firing chamber 39. Assuming the projection 113 is rotated to a position where it cannot contact with firing control member 111 on forward movement of the sliding bolt 15, the firearm is now ready for firing. For firing, trigger 73 is pulled whereby actuator 133 moves rightwardly causing control face 137 to pivot rocking lever 125 which pulls sear 123 downwardly releasing hammer 115. Since extended projection 139 does not contact with lever 131, sear 129 remains retracted and is of no effect.

A control pin 79 is provided in a manner similar to that described above with reference to control pin 79 in the FIG. 1 embodiment. That is, pin 79 is depressed by a projection 41 of the sliding bvolt 15 on its forward and rearward movements causing oversize plate 81 to depress actuator 133 downwardly, whereby control face 137 is uncoupled from lever 125 allowing lever 125 to bias sear 123 upwardly by means of spring 127. When the sliding bolt 15 moves rearwardly, by the force of the firing bullet, it again cocks hammer 115 by rotating it to a position where sear 123 engages with the hole provided in the undersurface of hammer 115. Release of trigger 73 and consequent leftward movement of actuator 133 by spring 87 (FIG. 7) allows actuator 133 to return to the position shown in FIG. 1 for another firing.

A control element 145 is provided which functions both as a safety and to control the movement of actuator 133 to select either an automatic or semiautomatic operation of the firearm. The control member 145 is in the shape of a half circle, includes a projection 146, and is rotated in accordance with rotation of a operating lever 149 provided on the exterior of the housing 13. In the position shown in FIG. 11, the actuator provides for a semiautomatic operation of the weapon as described above. In this position, a control face 153 provided on the actuator 133 moves unimpeded by the control member 145 such that the face 153 is movable both leftward and rightward as well as up and down relative to the control member 145. Of course a direct link can be provided between control emement 145 and rotatable control member 113 so that when semi-automatic operation is selected by control element 145, the rotatable control member 113 is rotated to a position where it does not contact with firing control member 111.

Figure 15A:
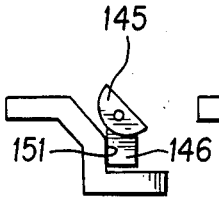
FIG. 15*a* illustrates a portion of a control lever of the FIG. 10 embodiment in a different operating position.
Figure 15B:
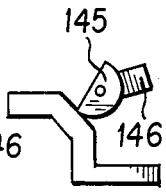
FIG. 15*b* illustrates the same portion of the firing mechanism as in FIG. 15*a*, but with the control lever in another operating position.

If the control member 145 is moved to the position shown in FIG. 15*a*, whereby an projection 146 abuts control face 151 of the actuator 133, the actuator 133 is prevented from rearward movement thereby providing a safety for the firearm. If the control member 145 is moved to the position illustrated in FIG. 15*b*, a fully automatic operation of the firearm is possible. In this position control member 145 depresses the actuator 133 which uncouples control face 137 from lever 125 thereby preventing operation of hammer 115. However, downward movement of actuator 133 causes control projection 139 to engage with lever 131 such that leftward movement of actuator 133 due to the biasing of trigger spring 87 causes projection 139 to pull lever 131 rocking it about pivot 142, causing sear 129 to project upwardly where it can engage with a front face of projection 41 of the sliding bolt 15 to hold the sliding bolt in its rearwardmost position.

Figure 16:
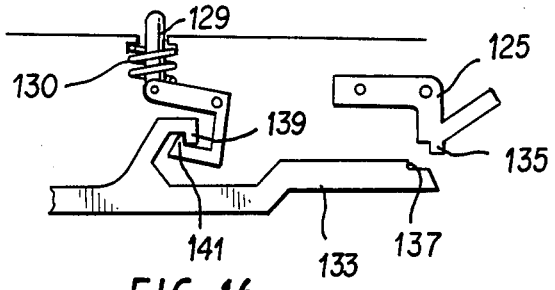
FIG. 16 illustrates a portion of the FIG. 11 mechanism in one of its operative states.

In this state, shown in greater detail in FIG. 16, pulling trigger 73 causes actuator 133 to move rightward and lever 131 to rotate counterclockwise (as viewed in FIGS. 11 and 16) by operation of spring 130 whereupon sear 129 is lowered to release sliding bolt 15 causing forward movement of the sliding bolt and the loading and firing of a bullet in the manner described above with respect to the first embodiment of the invention.

Figure 17:
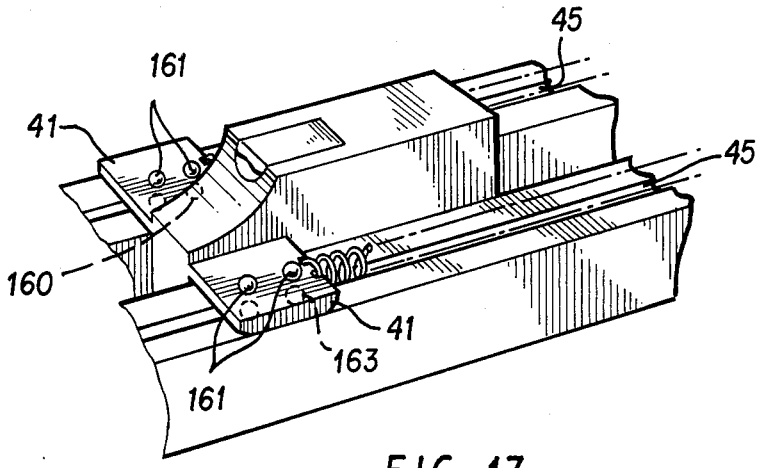
FIG. 17 illustrates a further modification of both embodiments of the invention.

FIG. 17 illustrates a modification of sliding bolt 15 which can be incorporated into either of the embodiments of the invention described above. In this modification, roller bearings in the form of ball bearings are used on the projections 41 of the sliding bolt 15. A pair of ball bearings 161 and a pair of ball bearings 163 are provided in recesses in respective upper and lower surfaces of the projections 41. The ball bearings for each projection 41 travel within the spring guides 45 of the firearm and provide less friction to the forward and rearward movement of sliding bolt 15. Sliding bolt 15 can be sized so that the only sliding contact between it and the housing is by way of the ball bearings providing it with an extremely fast movement.

As is evident from the foregoing discussion, the present invention is directed to a simple and easy to manufacture firearm which is capable of semiautomatic as well as automatic operation. In addition, by providing a removable rear cover on the housing, both the sliding bolt and firing mechanism supported thereon are easily removable from the housing for inspection, cleaning, repair, or replacement. In addition, the removable rear cover can be made removable by a simple twisting operation by an operator thereby further facilitating the ease of assembly and disassembly of the firearm. In addition, by providing an easily removable sliding bolt as well as a removable and easily replaceable barrel which contains the firing chamber, the firearm can accommodate different caliber bullets with ease and without requiring redesign of the housing and associated trigger mechanism. Still further, the sliding bolt moves within the interior area of the firearm housing to a point where on is rearward movement it just clears the end of a bullet casing with the rearend of the sliding member being substantially adjacent an interior rear wall of the housing, with the biasing for the sliding bolt being provided along its opposite sides, so that the firearm as a whole can be made shorter and more compact and with a short travel of the sliding bolt, thereby enabling a fast acting firearm, with the sliding bolt itself containing the firing mechanism.

The firearm is also capable of automatic or semiautomatic operation and is configurable with two different firing mechanisms in the second embodiment for added assurance of the firability of the firearm. Fast action of the bolt is also provided through the use of bearings between the bolt and housing.

Although various embodiments of the invention have been shown and described above, it should be apparent that many modifications can be made without departing from the spirit of the invention. Accordingly, the description above is to be taken as exemplary and not as limiting of the invention, the invention being defined by the claims appended hereto.

I claim:

1. A firearm comprising:

a reciprocal sliding bolt;

a housing comprising an interior open area, a firing chamber for holding a bullet for firing and positioned at one end of said open area, said open area having a portion thereof configured to guide a reciprocal path of movement of said sliding bolt forward towards said firing chamber and rearwardly away from said firing chamber, said sliding bolt loading a bullet into said firing chamber during said forward movement;

a firing mechanism comprising a firing pin, first means for normally retractably biasing said firing pin within said sliding bolt during rearward and at least a substantial position of forward movement of said sliding bolt, and means for extending said firing pin from said housing to strike a rear of a bullet within said firing chamber, said means for extending comprising:

a first member carried on said sliding bolt which is coupled to move said firing pin, a member supported by said housing and engaging with said first member at the termination of forward movement of said sliding bolt such that upon such engagement said first member moves to cause said firing pin to extend to fire a bullet, means for selectively moving said member supported by said housing to a first position where it is engageable with said first member and to a second position where it is not engageable with said first member, and a pivotal hammer having a rotation shaft fixed to a portion of said housing, said hammer being rotatable to a position for striking an end of said firing pin projecting from a rear side of said sliding bolt when said sliding bolt is at the termination of its forward movement to cause said firing pin to extend from said sliding bolt, whereby a bullet can be fired either by the engagement of said first member with said selectively movable member supported to said housing or by said hammer striking said end of said firing pin; and, second biasing means for biasing said sliding bolt forward toward said forward chamber.

2. A firearm as in claim 1, further comprising third biasing means for biasing said hammer in a direction of rotation to strike said firing pin, said hammer being rotated against said third biasing means to a cocked position by said sliding bolt during rearward movement thereof, said firing mechanism further comprising means for locking said hammer in said cocked position, and a trigger mechanism for releasing said locking means to allow said third biasing means to rotate said hammer to a position of striking said firing pin.

3. A firearm as in claim 2, wherein said hammer is retracted into a recess provided in an interior sidewall of said housing when cocked and pivots into said interior open area when said trigger mechanism releases said locking means.

4. A firearm as in claim 1, wherein said first member contains a slanted surface in contact with a slanted surface connected to said firing pin, said first biasing means causing said first member to project from said sliding bolt.

5. A firearm as in claim 1, wherein said first biasing means biases said first member and firing pin such that said first member normally projects from said sliding bolt, said first member, when engaging with said housing supported member reacting against the force of said first biasing means to cause said firing pin to extend from said sliding bolt.

6. A firearm as in claim 5, wherein said sliding bolt contains first and second bores extending therethrough at least partially in the direction of sliding movement of said sliding member and said first member and firing pin are first and second rods respectively extending through said bores, said first rod being a push rod positioned to normally project from a front face of said sliding bolt at a position radially outward of a rear casing of a bullet seated in said firing chamber, said second firing rod being normally retracted within said sliding bolt in said second bore at a position which overlaps a firing portion of a bullet seated within said firing chamber, said second rod extending from said sliding member by a pushing movement of said first rod which occurs by said first rod striking an interior front wall of said housing at the termination of forward movement of said sliding bolt.

7. A firearm as in claim 6, wherein said second rod has a first stepped portion, said second bore has a second stepped portion and said first biasing means comprises a compressed spring surrounding said second rod and engaging with said first and second stepped portions, for biasing said second rod inward of said sliding bolt and said first rod outward of said sliding bolt.

8. A firearm as in claim 7, further comprising a coupling means for coupling said first and second rods together, said coupling means comprising a lever pivoted to said sliding bolt and having a first end which is engageable with an end of said first rod which is opposite to the end extending from said bolt and a second end which is engageable with an end of said second rod which is opposite to an end which is extendable from said sliding bolt.

9. A firearm as in claim 8, wherein said pivot lever is pivoted at a rear side of said sliding bolt and is housed within a cavity provided at said rear side.

10. A firearm as in claim 1, wherein said second biasing means comprises a spring means engaging with a first portion of said sliding bolt and said housing, said spring means storing energy therein upon rearward movement of said sliding bolt and releasing stored energy to propel said sliding bolt forward.

11. A firearm as in claim 10, wherein said sliding bolt contains a pair of projections at a front portion thereof and said spring means comprises a pair of springs each having one end engaged with a respective projection and another end engaging with a rear portion of said housing.

12. A firearm as in claim 11, wherein said housing includes a pair of guide channels for respectively holding and guiding said pair of springs.

13. A firearm as in claim 12, wherein said housing includes at least a pair of longitudinal guide slots, said projections of said sliding bolt being guided by said guide slots, said guide slots including therein said guide channels.

14. A firearm as in claim 13, wherein said guide slots are open to the exterior of said housing.

15. A firearm as in claim 13 or 14, wherein said housing has a removable rear cover and said sliding bolt and pair of springs are removable from said housing through a rear opening which is closed by said removable rear cover.

16. A firearm as in claim 1, wherein said housing has an interior end wall which defines an end portion of said interior area and the termination of rearward movement of said sliding bolt, said sliding bolt having a rear wall, said rear wall of said sliding bolt being positioned substantially adjacent said interior end wall at the termination of rearward movement of said sliding bolt.

17. A firearm as in claim 1, further comprising means cooperating with said second biasing means for causing said second biasing means to initiate propulsion of said sliding bolt forward.

18. A firearm as in claim 17, wherein said means for initiating said propelling means is a trigger-operated mechanism.

19. A firearm as in claim 1, further comprising a trigger operated mechanism comprising:

a holding member for holding said sliding bolt at a rearward position of its sliding movement at which energy is stored in said second biasing means, a trigger, and means coupling said trigger with said holding member for causing said holding member to release said sliding bolt for forward movement by said second biasing means upon actuation of said trigger.

20. A firearm as in claim 1, wherein said housing includes an opening to the exterior, and further comprising means engaging with a spent casing propelled rearwardly of said chamber by the force of firing for expelling said spent casing through said opening.

21. A firearm as in claim 20, wherein said expelling mechanism comprises a first member fixed along a path of rearward movement of said sliding bolt at a position for engaging with an edge of a rearwardly propelled spent casing to provide a pivot about which said spent casing can rotate, and a second releasable grasping member mounted on said sliding bolt at a position for grasping a rear peripheral portion of a casing at least when said sliding bolt moves rearwardly, said grasping member initially pulling said casing about said pivot as said casing is propelled rearwardly and then releasing said casing causing it to be propelled out of said housing through said opening.

22. A firearm as in claim 1, wherein said housing has a removable rear cover and said sliding bolt is slidably removable from said housing through a rear opening which is a continuation of said interior area and which is closed by said removable rear cover.

23. A firearm as in claim 1, wherein said housing has guide slots therein and said sliding bolt has projections respectively extending into said slots to be guided thereby.

24. A firearm as in claim 23, wherein said slots are provided at least at opposite sidewalls of said housing.

25. A firearm as in claim 23, wherein at least one said projection on said sliding bolt extends through an associated slot which is open to the exterior of said housing and projects out of said housing whereby it is graspable to manually move said sliding bolt rearwardly.

26. A firearm as in claim 1, further comprising means for delivering a bullet to said path of forward movement of said sliding bolt.

27. A firearm as in claim 26, wherein said delivery means comprises a bullet clip for housing a plurality of stacked bullets therein.

28. A firearm as in claim 1, further comprising means for holding said sliding bolt from forward movement when it reaches a predetermined position on its rearward movement.

29. A firearm as in claim 1, wherein said housing includes a longitudinal slot open to the exterior, said sliding bolt including a portion moving along and within said slot, said device further comprising a pivotable grasping element rotatably supported by said portion of said sliding bolt and a fourth biasing means for biasing said grasping element to a position where it does not project from said slot, said grasping element being graspable for rotation to extend out of said slot whereby said sliding bolt can be manually moved rearwardly.

30. A firearm as in claim 1, wherein said housing has a rear wall defining a rearward end of said interior open area, said open area having a longitudinal extent which is substantially equal to a length of a bullet to be loaded and the length of said sliding bolt, a rearwardmost portion of said sliding bolt being substantially adjacent to said rear wall during rearwardmost movement of said sliding bolt.

31. A firearm as in claim 30, wherein a front, bullet loading face of said sliding bolt just clears a bullet provided in a bullet loading area of said housing when said sliding bolt is in a rearwardmost position.

32. A firearm as in claim 1, further comprising a removable barrel attached to said housing at an end of said interior area, said barrel containing said firing chamber at one end thereof.

33. A firearm as in claim 32, further comprising means for releasably securing said barrel to said housing.

34. A firearm as in claim 32, wherein said releasably securing means is an insertion and twist mount.

35. A firearm as in claim 1, wherein said housing comprises a front wall and a plurality of members longitudinally extending from said front wall to define slots open to the exterior of said housing between adjacent extending members, said interior area being defined by inner surfaces of said members, said members being coupled together at their ends opposite said front wall by a rear cover.

36. A firearm as in claim 35, wherein said sliding bolt has a pair of projections therein which slide along respective slots formed by adjacent extending members.

37. A firearm as in claim 36, wherein said projections are provided at a front portion of said sliding bolt and said second biasing means comprises a plurality of springs respectively engaging with said projections and said rear cover.

38. A firearm as in claim 37, wherein said slots include respective guide channels for said springs.

39. A firearm as in claim 37, wherein said rear cover is removable to allow removal of said sliding bolt and said springs from said housing.

40. A firearm comprising:

a reciprocal sliding bolt;

a housing comprising an interior open area, a firing chamber for holding a bullet for firing and positioned at one end of said open area, said open area having a portion thereof configured to guide a reciprocal path of movement of said sliding bolt forward towards said firing chamber and rearwardly away from said firing chamber, said sliding bolt loading a bullet into said firing chamber during said forward movement;

a firing mechanism comprising a firing pin, first means for normally retractably biasing said firing pin within said sliding bolt during rearward and at least a substantial position of forward movement of said sliding bolt, and means for extending said firing pin from said housing to strike a bullet within said firing chamber when said sliding bolt is substantially at the termination of its forward movement, said means for extending comprising a first member carried on said sliding bolt which is coupled to said firing pin, and a selectively operable member supported by said housing and movable to a position engaging with said first member at the termination of forward movement of said sliding bolt such that upon such engagement said first member moves to cause said firing pin to extend from said sliding bolt whereby a bullet can be fired, said means for extending further comprising a pivotal hammer having a rotation shaft fixed to a portion of said housing, said hammer being rotatable to a position for striking an end of said firing pin projecting from a rear side of said sliding bolt, when said sliding bolt is at the termination of its forward movement, to cause said firing pin to extend from said sliding bolt, whereby a bullet can be fired either by the engagement of said first member with said selectively operable member or by pivoting movement of said hammer; and second biasing means for propelling said sliding bolt forward toward said firing chamber, said second biasing means engaging at one end with said sliding bolt at a forward portion thereof and at another end with said housing and extending along at least a portion of a longitudinal extend of said bolt.

41. A firearm as in claim 40, further comprising means for moving said selectively operable member to a first position where it is engageable with said first member upon termination of forward movement of said sliding bolt and to a second position where it is not engageable with said first member upon termination of forward movement of said sliding bolt.

* * * * *